United States Patent [19]

Prade

[11] Patent Number: 4,671,199

[45] Date of Patent: Jun. 9, 1987

[54] RIG FOR A WINDSURFING BOARD

[75] Inventor: Ernstfried Prade, Weilheim, Fed. Rep. of Germany

[73] Assignee: Mistral Windsurfing AG, Bassersdorf, Switzerland

[21] Appl. No.: 710,882

[22] Filed: Mar. 12, 1985

[30] Foreign Application Priority Data

Mar. 13, 1984 [DE] Fed. Rep. of Germany ..... 3409125
Aug. 14, 1984 [DE] Fed. Rep. of Germany ..... 3429933

[51] Int. Cl.[4] ..... B63H 9/04

[52] U.S. Cl. ..... 114/39; 114/98; 114/99

[58] Field of Search ..... 114/39.2, 89–99, 114/102, 103; 441/74, 75

[56] References Cited

U.S. PATENT DOCUMENTS 4,365,570 12/1982 Jamieson ..... 114/39.2
4,448,142 5/1984 Pollard ..... 114/39.2

FOREIGN PATENT DOCUMENTS 21447 1/1981 European Pat. Off. ..... 114/39.2
2941134 4/1981 Fed. Rep. of Germany ..... 114/39.2
3224848 1/1984 Fed. Rep. of Germany ..... 114/39.2
8201525 5/1982 PCT Int'l Appl. ..... 441/75
2105280 3/1983 United Kingdom ..... 114/39.2

*Primary Examiner*—Joseph F. Peters, Jr.
*Assistant Examiner*—Stephen P. Avica
*Attorney, Agent, or Firm*—Armstrong, Nikaido, Marmelstein & Kubovcik

[57] ABSTRACT

The invention relates to a rig for a windsurfing board in which the clew (8) of the sail (2) prior to tensioning and trimming of the sail (2) is fixed in location in a stern fitting (10) of the wishbone boom (3). The stationary fixing can either be done preprogrammed with the aid of a scale, whereupon the wishbone boom (3) is fixed to the mast in that it is pushed downwardly from above and engaged, or a fixed point is established which holds the clew (8). In this embodiment the trimming of the said (2) is made in the bow fitting (11) in that the connection (15) between the mast (1) and wishbone boom (3) is constructed in such a manner that the mast (1) is displaceable longitudinally to and fro with respect to the wishbone boom (3) and lockable.

21 Claims, 20 Drawing Figures

6
11
15
12
14
13
8
3
10
9
2
7
1
4
5

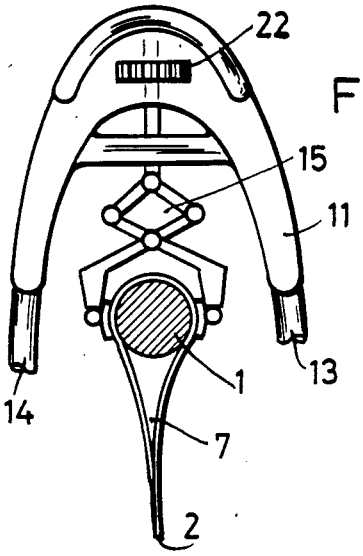
Fig. 10
Fig. 11
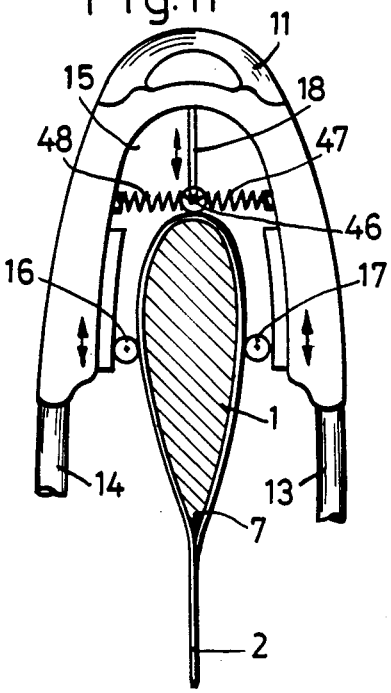
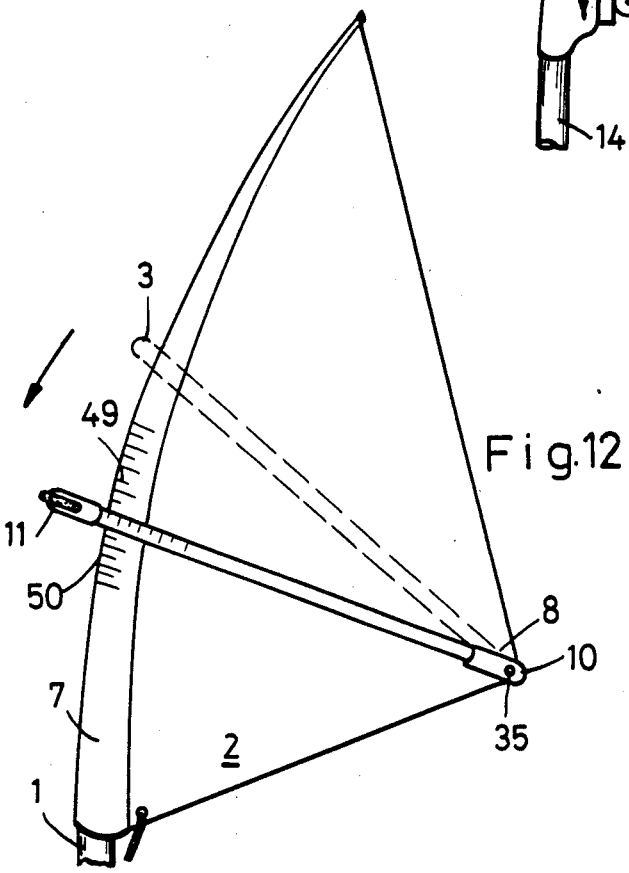
Fig. 12

RIG FOR A WINDSURFING BOARD

The invention relates to a rig for a windsurfing board comprising a mast, a sail which is held by the mast and tensioned by means of a wishbone boom and which receives the mast in a mast pocket forming the fore leech, the rig being unstayed with respect to the windsurfing board and secured by means of a joint freely rotatably and pivotally in all directions on the windsurfing board being held by the user at the wishbone boom and thereby adjusted relatively to the wind and the windsurfing board, the sail being connected to the wishbone boom only at the boom head, the lower leech of the sail extending from the boom head inclined downwardly to the mast, and the wishbone boom being disposed above the sail tack, the wishbone boom comprising two outwardly curved booms and a bow fitting securable to the mast and a stern fitting for holding the clew, the booms being connected together by the bow and stern fittings.

Such rigs for windsurfing boards are generally known. In the more recent development of windsurfing it has been found that in particular every gram of weight in the region of the stern fitting of such a wishbone boom is disadvantageous to the handling of the rig. However, at the same time the trend has been to use sails of different sections for various board designs and in particular various wind conditions. The usual wishbone booms therefore have a fixed length corresponding to the largest sail. If smaller sails are used a corresponding overhang results which by lengthening the lever increases the detrimental effect of the weight at the stern fitting. As a rule, in such rigs belaying cleats, guide pulleys and similar means are mounted in the region of the stern fitting because in the usual form of the rig the clew is secured by a rope at the wishbone boom end which permits trimming in the direction of the stern fitting. To reduce the disadvantageous leverage effect resulting from the overhang of the wishbone boom stern fitting beyond the clew, variable wishbone booms have also already been proposed (cf. European patent application No. 00 71 220) by means of which the entire length of the wishbone boom can always be adapted to the corresponding sail size. However, in all known rigs for technical reasons alone a space always remains between the outermost rear end of the wishbone boom stern fitting and the clew because a clearance must be provided for trimming the sail by moving the clew in the direction of the rear end. An additional difficulty is that following the tendency to cut modern sails increasingly flatter and to use accordingly harder masts, a complete trimming and tensioning of the sail is possible only by exerting a force which can hardly be applied in practice. In this respect a remedy has been sought in providing various gearings and pulley-block arangements in the stern fitting or in the combination of stern fitting and clew. This further increases the weight precisely in the region of the stern fitting.

In the light of the foregoing the invention is based on the problem of providing a rig of the type mentioned at the beginning in which the sail can be trimmed with the minimum force application, it being possible to establish a minimum and constant spacing of the clew from the wishbone boom rear end so that a very light construction is made possible, in particular in the rear wishbone boom portion.

This problem is solved according to the invention substantially by the features set forth in claim 1.

Further advantageous details are set forth in the subsidiary claims following the main claim.

With this fundamental construction according to the invention the advantage is achieved in particular that in accordance with the given sail cut or sail size firstly completely without effort or with minimum sail tension the clew can be fixed in the stern fitting in accordance with the optimum trim, whereafter the tensioning takes place utilizing the entire leverage of the wishbone boom length by pivoting the latter from the top of the sail downwardly into the desired end position. In complete contrast to the prior art, the approach adopted here is to set the programmed trim without effort and then, using a considerable leverage, tension and optimally trim the sail.

In a particularly preferred further embodiment of the invention it may be additionally provided that the aforementioned connection between the mast and the wishbone boom is constructed in such a manner that for trimming the sail the mast is displaceable to and fro in the longitudinal direction of the wishbone boom.

It is obvious that with the present invention a completely different path is taken in that the sail is no longer trimmed by displacing the clew with respect to the wishbone boom but instead the final trim of the sail is obtaind by moving the mast in the direction of the bow fitting. This makes it possible to relieve precisely the stern fitting of the wishbone boom of all fittings so that the stern fitting can be made very light. In addition, the invention has the advantage that the clew of the sail may be disposed directly in the stern fitting of the wishbone boom so that any undesirably acting overhang is avoided.

In an advantageous further development of the invention the connection between the mast and wishbone boom is constructed as three-point mounting which holds the mast by frictional engagement. This embodiment has the advantage that the wishbone boom can be set to any desired level.

The three-point mounting preferably comprises friction members which are in contact with the mast and the mast pocket of the sail.

In this connection it is particularly preferred to construct at least two of the friction members as rollers whose axes of rotation lie substantially parallel to the mast.

In the rig according to the invention a further preferred embodiment resides in that the sail is formed with through mast pocket and that the frictional engagement is established with the outside of the mast pocket. This results in the special advantage that the aerodynamic cutout which known sails have to permit securing of the wishbone boom is avoided.

It is preferred in detail to provide two bearing points symetrically laterally behind the mast, the spacing of the bearing points being somewhat smaller than the diameter of the mast and the third bearing point being disposed in the center axis of the wishbone boom in front of the mast. As a result the airfoil profile of the sail starting through the mast pocket is hardly impaired because the constriction produced by the two lateral bearing points is minimized.

The third bearing point is preferably made resilient in the longitudinal direction.

For trimming the sail it is advantageous for the bearing points to be adjustable in the longitudinal direction of the wishbone boom by adjustment means disposed in the bow fitting.

To take account of different wishbone boom heights depending on the size of the user the bearing points are advantageously made pivotal.

In particular, it is preferred that the mast has a drop-shaped or double airfoil-shaped cross-section and that the engagement point of the third bearing point is resiliently suspended on both sides perpendicularly to the center line of the wishbone boom in such a manner that the mast can execute a sprung rotational movement about its axis.

This embodiment has the advantage that in the more recent development of the so called wing rig an optimal trim is possible and nevertheless the intended pivot movement or rotational movement of the mast for changing the angle of a tack to the airflow can be carried out.

In a particularly preferred embodiment the fitting comprises a securing means for holding the clew which is advantageously formed by a shaft extending through the clew.

A particularly preferred embodiment is that the stern fitting is divided and connectable by a fastener.

In particular the fastener can be formed by a shaft which is fixedly connected to one half of the stern fitting and a slide which is disposed in the other half and which is adapted to engage into a groove at the free end of the shaft.

In modified embodiments the stern fitting may comprise a slot receiving the clew, a bore being provided through which the shaft can be pushed through the clew.

In particular, the stern fitting should be interchangeable so that depending on personal taste a conventional stern fitting with trimming in the direction of the stern fitting can be used.

In particular, the invention can be further developed in that the wishbone boom comprises in the region of the bow fitting a bend permitting folding of the wishbone boom parallel to the mast. This folding is advantageous for laying the rig together in emergency situations or for transport and because of the bend this can be done without removing the bearing points of the three-point mounting.

In a further development of the invention at the mast or on the mast pocket of the sail and in the bow region of the wishbone boom scales are provided which are correlated with each other for optimal trim.

Further advantageous details of the invention will be apparent from the following description or claims and the embodiments illustrated by way of example in the drawings, with the aid of which the invention will be explained in exemplary manner hereinafter. In the drawings:

FIG. 10 is a modified embodiment of a bow fitting in a view corresponding to FIG. 3;

FIG. 11 is a view of a bow fitting corresponding to FIG. 3 in a so called wing rig; and FIG. 12 is a schematic side view of the rig according to the invention showing the rigging and trimming operation.

Figure 1:
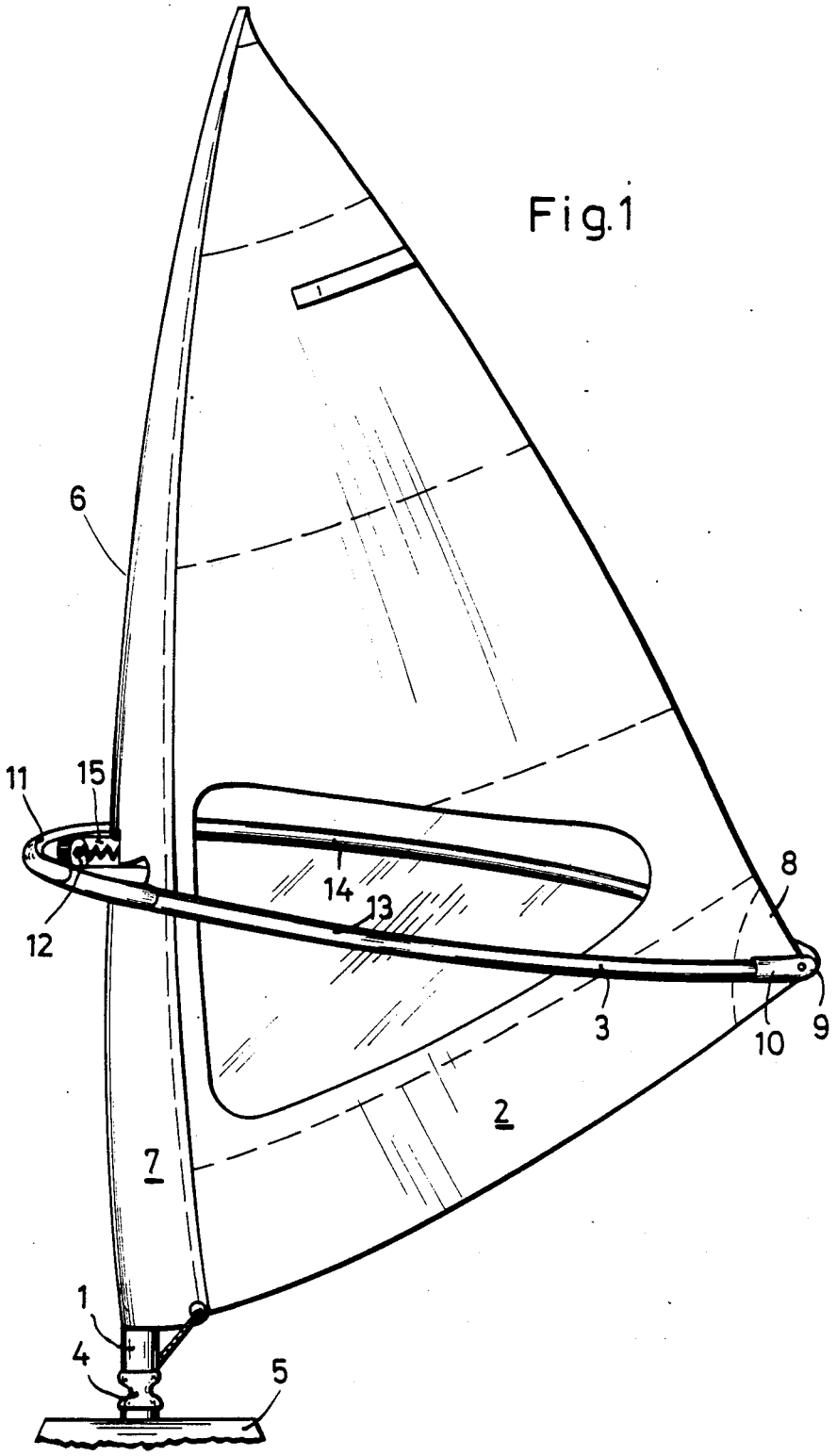
FIG. 1 is a schematic overall view of the rig according to the invention.

The embodiments of the rig according to the invention shown in the drawings consist in all cases of the mast 1, the sail 2 and a wishbone boom 3, the rig being connected to the windsurfing board 5 at the lower end of the mast 1 by a universal joint 4. The sail is adjusted by the user relatively to the wind and the windsurfing board in known manner by holding the wishbone boom 3.

As apparent in FIG. 1 the fore leech 6 of the sail 2 is formed by a mast pocket 7 which receives and holds the mast 1. The clew 8 of the sail 2 is secured to the head 9 of the wishbone boom 3, said boom head being formed by a stern fitting 10.

In the embodiment illustrated in FIG. 1 the wishbone boom 3 comprises a bow fitting 11 by means of which the mast 1 can be moved forwardly and rearwardly with respect to the wishbone boom 3 for optimum trimming of the sail 2. In FIG. 1 the trimming means is designated generally by 12 and will be explained in detail hereinafter with reference to the various embodiments.

The wishbone boom 3 consists of two outwardly curved booms 13, 14 which are connected together at the front by means of the bow fitting 11 and at the rear by the stern fitting 10. The bow fitting 11 with the trimming means 12 forms a connection 15 between the wishbone boom 3 and the mast 1.

Figure 2:
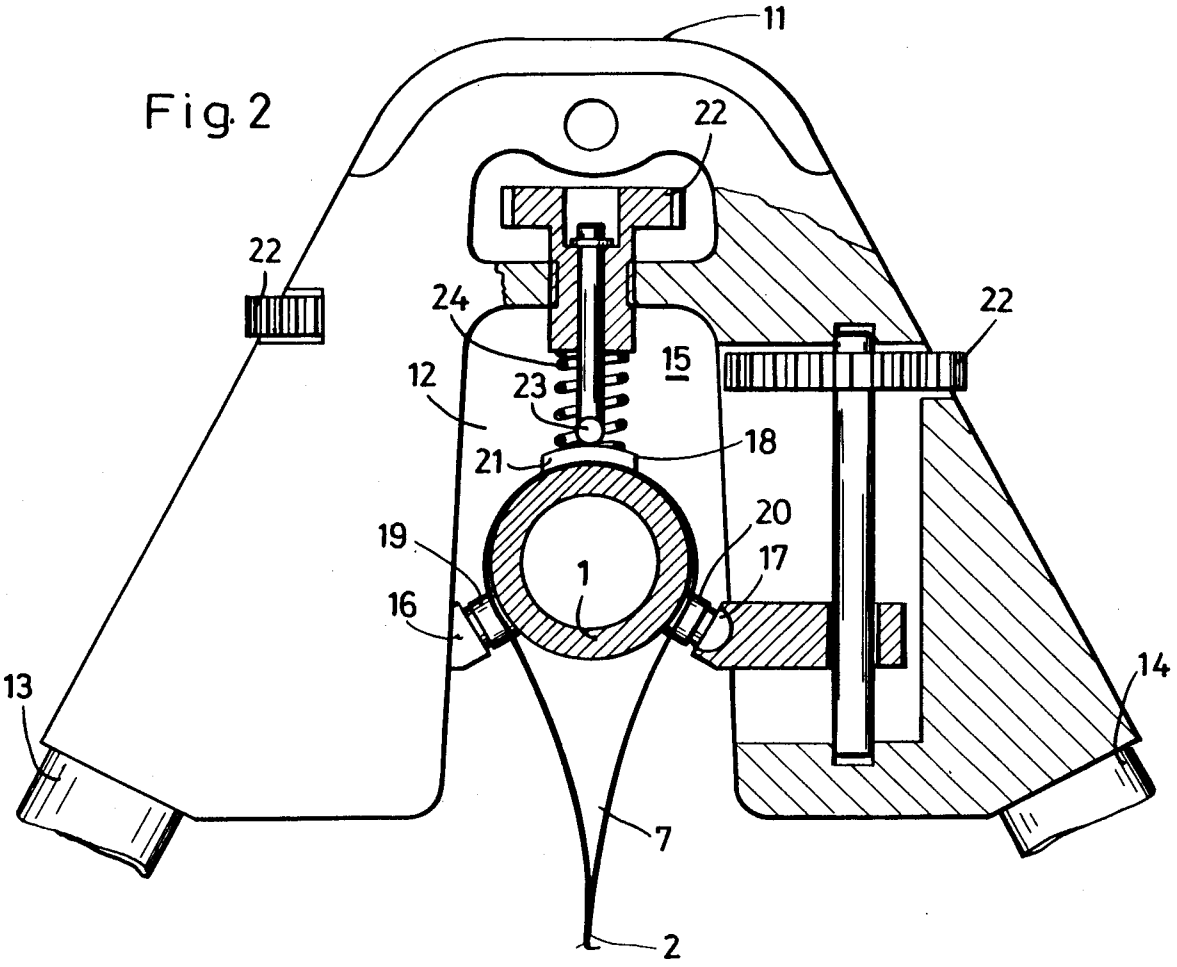
FIG. 2 is an enlarged sectional view of the bow region of the wishbone boom in the rig according to FIG. 1.

FIG. 2 shows a schematic sectional view perpendicular to the mast 1 of a first embodiment of the trimming means 12 by which the mast 1 can be moved forwards and rearwards with respect to the wishbone boom 3 on the center axis thereof for varying the tension of the sail 2 and thus the trim. In FIG. 2 and well as in the other Figures of the drawings identical parts are provided with the same reference numerals so that with regard to these parts reference can be made to the respective preceding description.

As apparent from FIG. 2 the connection 15 between the mast 1 and wishbone boom 3 is formed a three-point mounting, two bearing points 16, 17 lying somewhat behind the center line of the mast cross-section and the third bearing point 18 lying at the front side of the mast 1. The three-point bearing resulting has friction members 19, 20, 21 which hold the mast 1 and the mast pocket of the sail 2 surrounding said mast under frictional engagement. It is obvious that as a result the sail 2 can be provided with a through mast pocket 7 which is very favourable aerodynamically because as a consequence the otherwise usual output of the mast pocket can be omitted.

As illustrated, the bearing points 16, 17 and 18 are adjustable in the longitudinal direction of the wishbone boom 3 by adjustment drives referred to generally by 22. In the example of embodiment according to FIG. 2 spindle drives are provided for this purpose but it is obvious to the expert that any other possible type of adjustment may be used. The drives illustrated thus serve only as an example of the basic principles according to the present invention.

In the example of embodiment according to FIG. 2 the mast 1 may thus be adjusted axially with respect to the wishbone boom 3 so that as a result the desired tension can be imparted to the sail 2.

It should also be emphasized that the bearing points 16, 17, 18 and the friction members 19, 20, 21 in all embodiments, i.e. also in the embodiment of FIG. 2, are mounted pivotally, for which purpose in the example of embodiment according to FIG. 2 articulation joints 23 are provided. The pivotal mounting insures that various wishbone boom heights are possible.

As further illustrated the forward bearing point 18 is made resilient, for which purpose in the example of embodiment a helical spring 24 is provided. This spring arrangement takes up shocks which otherwise could lead to breakage of the mast 1.

As apparent from FIG. 2 the distance of the two bearing points 16, 17 behind the mast 1 is such that the spacing of the bearing points 16, 17 from each other is somewhat less than the diameter of the mast 1. As a result hardly any constriction of the mast pocket 7 is produced, the latter of course being part of the airfoil profile of the sail 2.

Figure 3:
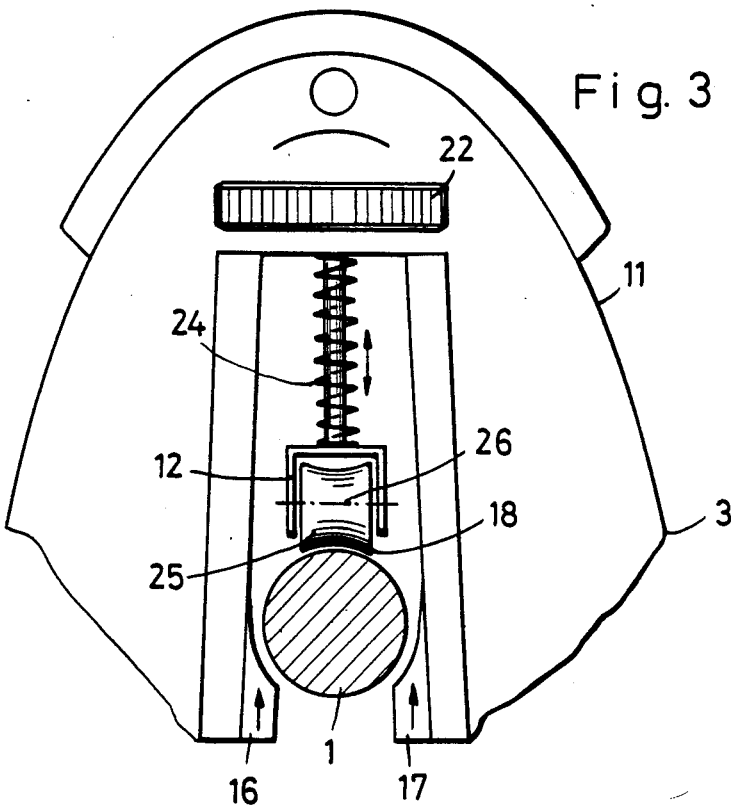
FIG. 3 is a plan view of a modified embodiment of the bow region of the wishbone boom.

In the embodiment according to FIG. 3 the third bearing point 18 is constructed as roller 25 which is mounted rotatably transversely of the mast 1 on a shaft 26.

This embodiment facilitates the rigging explained in detail below. Furthermore, the three bearing points of the three-point mounting are connected to a common adjustment drive 22 so that to trim the sail to only this adjustment drive need be actuated.

Figure 4:
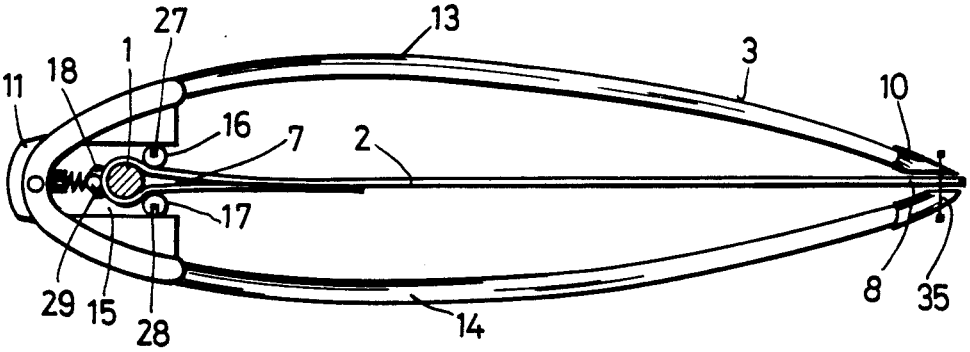
FIG. 4 is a schematic plan view of a wishbone boom in a modified embodiment.

In the embodiment according to FIG. 4 the bearing points 16, 17, 18 are constructed as rollers 27, 28, 29 whose axes of rotation lie substantially parallel to the mast 1. The rollers 27, 28, 29 serving as friction members simultaneously provide pivotal mounting thereof.

FIG. 4 shows schematically that in all examples of embodiment the clew 8 can be fixed in the stern fitting 10 of the wishbone boom 3 because trimming of the sail 2 is effected in the bow fitting 11 of the wishbone boom 3. Details of this fixing will be given below.

Figure 5:
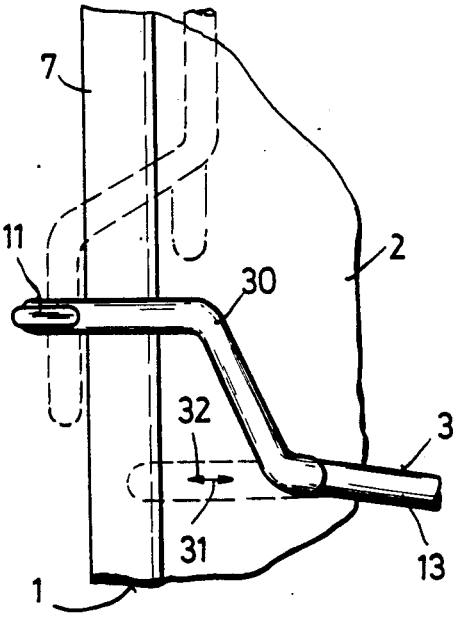
FIG. 5 is a schematic side view of the bow region of the wishbone boom in two positions.
Figure 6:
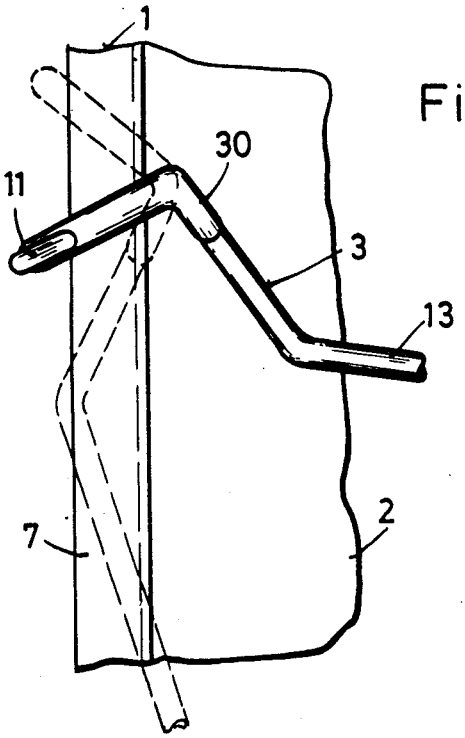
FIG. 6 is a view corresponding to FIG. 5 of a modified embodiment.

In FIGS. 5 and 6 in two examples of embodiment a further advantageous detail of the rig according to the invention is illustrated which in spite of the three-point mounting makes it possible in emergency situations or for transport to fold the wishbone boom 3 parallel onto the mast 1. As shown in the two Figures, in each of which the dashed lines represent the folded position, the wishbone boom 3 comprises a bend 30 which on folding brings the bearing points out of engagement with the mast 1. As a result, it is additionally achieved that the force engagement of the tensile forces exerted on the wishbone boom 3 in favourable manner is higher in the mast 1.

FIG. 5 shows schematically a lower extension 31 as further alternative, the two rear adjustable bearing points 16, 17 being disposed in said extension as indicated by the arrow 32.

Figure 7:
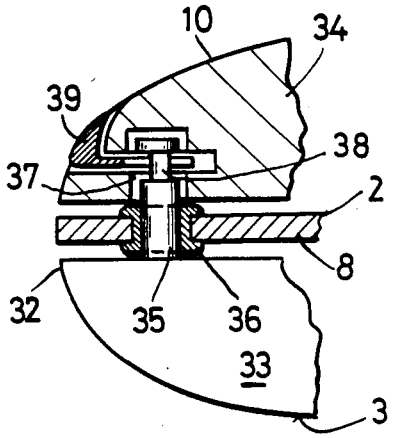
FIG. 7 is a schematic partially sectioned view of an embodiment of the stern fitting.
Figure 8:
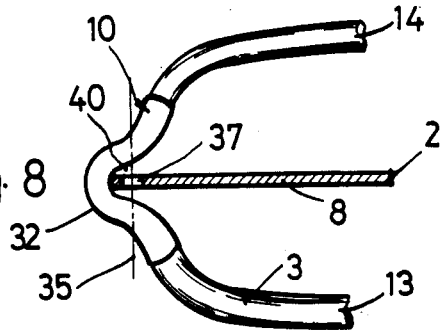
FIG. 8 is a schematic plan view of an alternative embodiment of the stern fitting.
Figure 9:
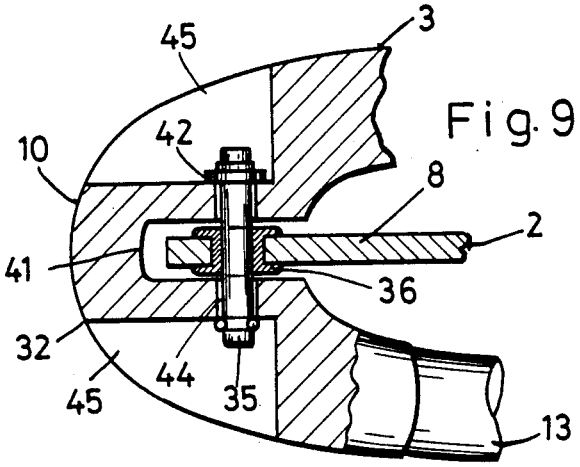
FIG. 9 is a sectional view corresponding to FIG. 7 of another embodiment of the stern fitting.
Figure 13:
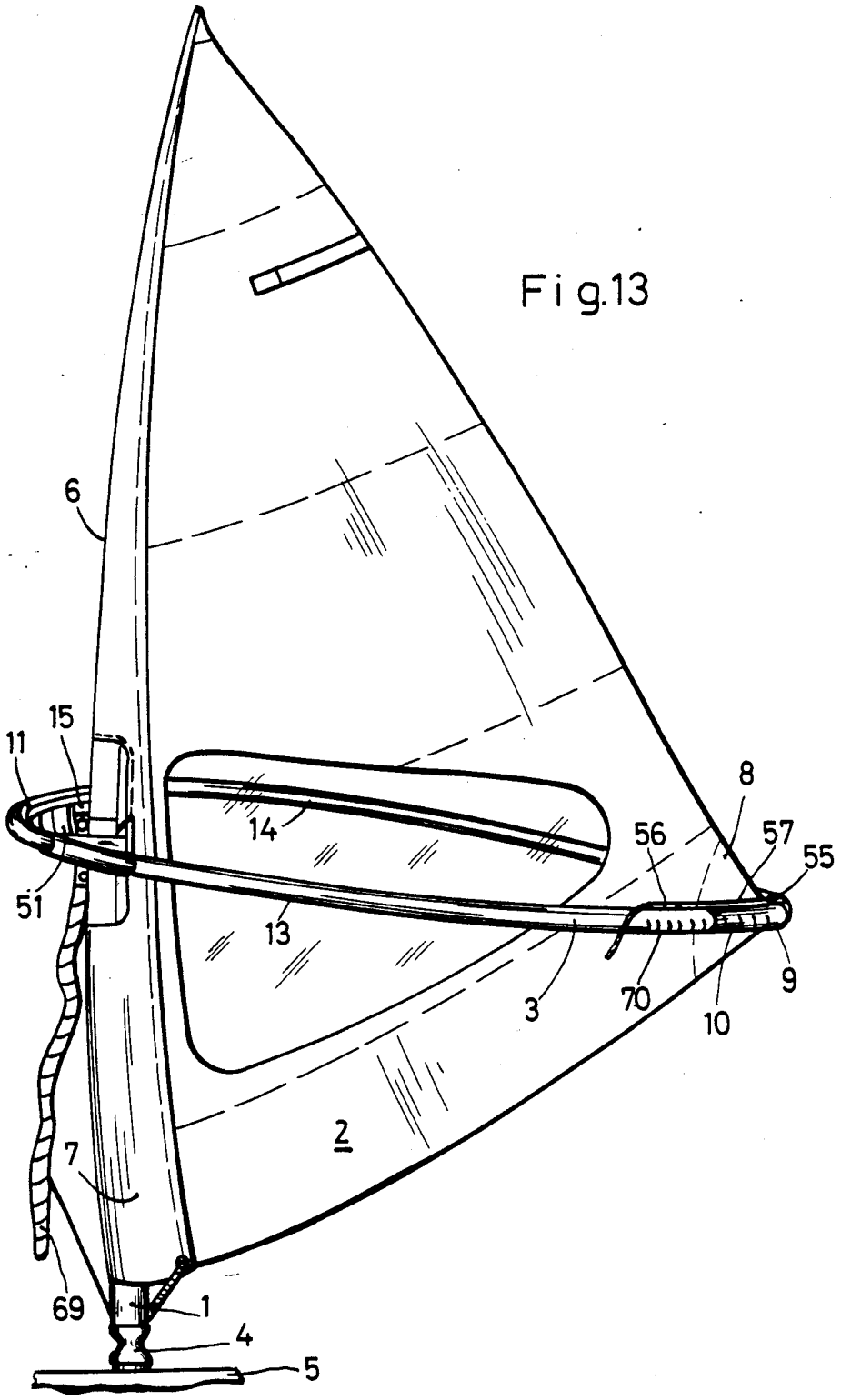
FIG. 13 is an overall view corresponding to FIG. 1 of a modified embodiment.

In FIGS. 7 to 9 in three different embodiments a securing means disignated generally by 32 is shown for holding the clew 8 of the sail 2 in the stern fitting 10 of the wishbone boom 3.

Since as apparent from the above description the clew 8 can be held fixed in location in the stern fitting 10, in the embodiment of FIG. 7 the wishbone boom 3 is divided so that the stern fitting 10 comprises two halves 33, 34. Provided at the lower half 33 in FIG. 7 is a shaft 35 fixedly connected thereto which is led through the eye 36 of the clew 8. The shaft 35 engages through a bore 37 in the upper half 34 of the stern fitting 10 and comprises a groove 38 at its free end. For closing the stern fitting 10 a slide 39 is provided which can engage in fork like manner in the groove 38. By this arrangement the wishbone boom 3 is closed and also the clew 8 is held securely and directly in the free end of the wishbone boom 3.

In the embodiment of FIG. 8 the stern fitting 10 is provided with a turned-in portion 40 through which by means of bores (not shown) the shaft 35 is passed. In this case as well the clew lies directly in the stern fitting 10.

In the embodiment of FIG. 9 the stern fitting 10 comprises a slot 41 for receiving the clew 8 and the shaft 35 is formed by a so called ball lock pin 42 which can be released by pressing on a knob 43. The ball lock pin 42 is led through bores 44 and through the eye 33 of the clew 8 and holds the latter reliably in the stern fitting 10. In the example of embodiment according to FIG. 9 the bores 44 open into lateral recesses 45 of the stern fitting 10 to avoid any danger of injury because these recesses 45 receive the projecting portions of the shaft 35.

FIG. 10 shows a schematic illustration of an alternative form of the connection 15 between the mast 1 and wishbone boom 3 constructed in the manner of double shears so that the frictional engagement on the mast 1 and mast pocket 7 is increased with increasing pull on the sail 2. The advantage of this embodiment is the simple construction and the fact that only a single adjustment means 22 is needed.

FIG. 11 shows in schematic illustration the application of the basic principles of the present invention to a so called wing rig in which the mast 1 has a drop-shaped or double airfoil-shaped cross-section.

In this embodiment the engagement point 46 of the frontmost bearing point 18 of the three-point mounting is suspended resiliently by means of helical springs 47, 48 or elastic members on both sides of the center line of the wishbone boom 3 so that the mast 1 can execute a sprung rotational movement about its axis. This modification of the rig according to the invention is advantageous when using a wing rig in which the angle of a tack of the mast 1 and thus the sail profile can be varied.

FIG. 12 shows schematically the operation of the initial trimming or rigging. As shown, after the clew 8 has been connected via the shaft of pin 35 to the stern fitting 10 the wishbone boom 3 is first pivoted downwardly into the desired position. This itself tensions the sail 2 by bending the mast 1. At the height desired by the user fine trimming is then made using the means described above.

In this respect for each specific sail there is an optimum setting which in turn depends on the height of the wishbone boom 3. Therefore, according to the invention on the mast pocket 7 and the wishbone boom 3 scales 49 and 50 are provided which each indicate the optimum position. The division of the scales 49 and 50 is chosen such that for a given vertical position of the wishbone boom 3 on the scale 50 only the corresponding setting on the scale 49 needs to be made.

The embodiments illustrated in FIGS. 13 to 20 differ from the embodiments previously described in that the connection 15 between the mast 1 and the wishbone boom 3 is made differently in that no provision is made therein for adjustment for trimming the sail 2. Instead, corresponding to a scale 70 provided for example at the stern fitting 10 of the wishbone boom 3, the clew 8 is fixed in an optimum position with respect to the rear end of the wishbone boom 3 and thereafter the sail 2 tensioned and trimmed by pivoting the wishbone boom 3 from the top of the sail 2 downwardly in accordance with FIG. 12. For this purpose the wishbone boom 3 is adapted to be fixed with respect to the mast 1 in the end position then reached.

In the embodiments illustrated in FIGS. 13 to 20 for this purpose a coupling means 51 is provided which is operative between the bow fitting 11 and the mast 1.

Figure 14:
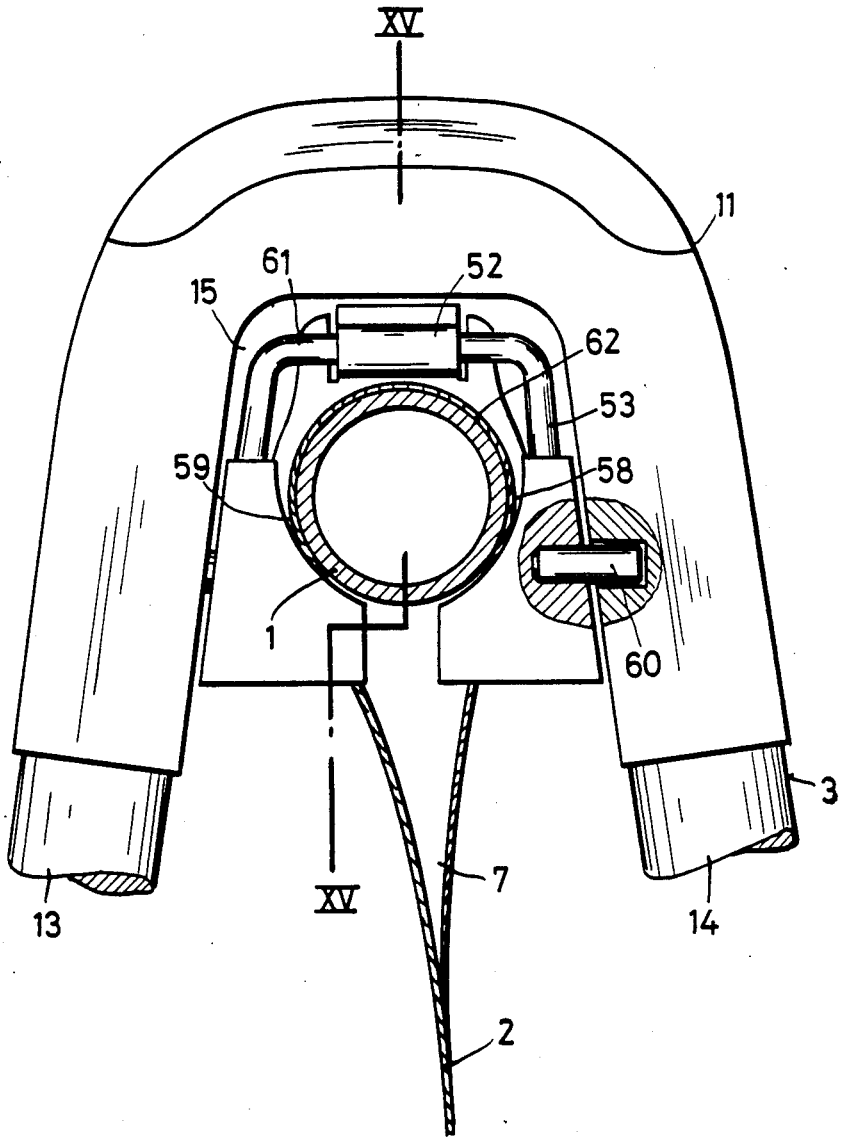
FIG. 14 is an enlarged partially sectioned view of the bow fitting of the wishbone boom in the rig according to FIG. 13.
Figure 15:
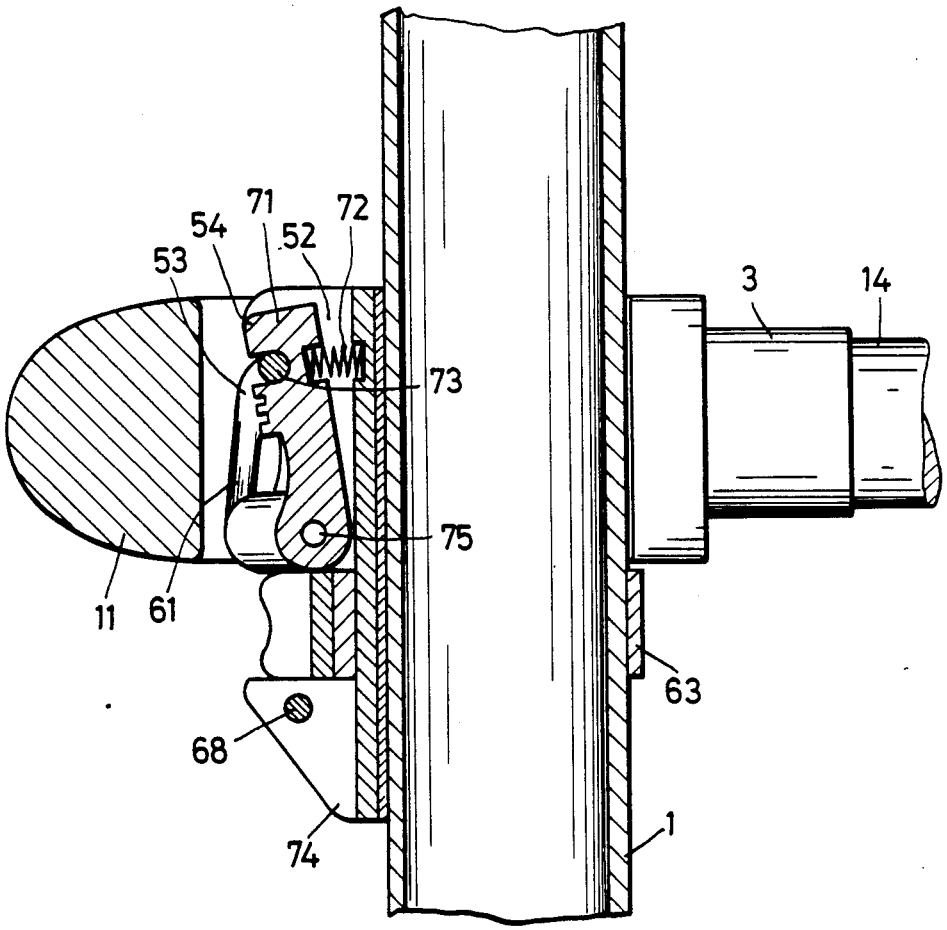
FIG. 15 is a sectional view of FIG. 14 along the line XV—XV without sail.

Details of an embodiment of this coupling means 51 are shown in FIGS. 14 and 15, the same reference numerals for corresponding parts as in the above description being used for FIGS. 13 to 20.

As shown, the coupling means 51 consists of two parts, that is a manually releasable pawl means 52 which is secured vertically adjustably on the mast 1 and a catch or detent means 53 which is mounted in the bow fitting 11.

The pawl means 52 is provided on the upper side of the actual pivotally mounted pawl 31 with a cam face 54 by means of which the pawl 71 is disengaged against the pressure of a helical spring 72 which biases the pawl 71 into the closure position. The cam face 54 in the embodiments shown is shaped in such a manner that the pawl 71 is pivoted when traversed by the bow fitting 11 or the catch or detent means 53 secured thereto.

In the embodiment illustrated in FIGS. 14 and 15 the catch means 53 comprises bearing faces 58, 59 engaging on both sides on the stern side of the mast 1 and corresponding in their function to the bearing points 16, 17 of the embodiment previously described.

The bearing faces are pivotal about pins 60 to permit the folding down of the wishbone boom 3 described above or to insure any desired relative position with respect to the mast 1.

In the embodiment shown the two pivotal bearing faces 58, 59 on the bow side of the mast are connected by a stirrup member 61 or the like which engages in a corresponding notch 73 in the pawl 71.

The pawl means 52 is pivotally mounted on a housing 74 on a pin 75, the housing 74 comprising a hemispherical bearing face 62 havig a friction-increasing inner lining 76 which partially surrounds the mast 1. For holding the housing 74 in any desired vertical position on the mast a fastening means designated generally by 63 is provided.

In the preferred embodiments according to FIGS. 13 to 20 the fastening means 63 is constructed as plastic band 64 which is connected to the housing 74 and which engages round the mast and can be fixed in an eccentric clasp 65 in the manner of a ski boot clasp.

This design insures that the wishbone boom 3 in accordance with the vertical position of the housing 74 chosen on the mast 1 is reliably held after engagement whilst the main forces are taken up by the bearing faces 58, 59.

Beneath the pawl means 52 in both embodiments a pin 68 is provided to which the start rope 69 may be secured.

Figure 16:
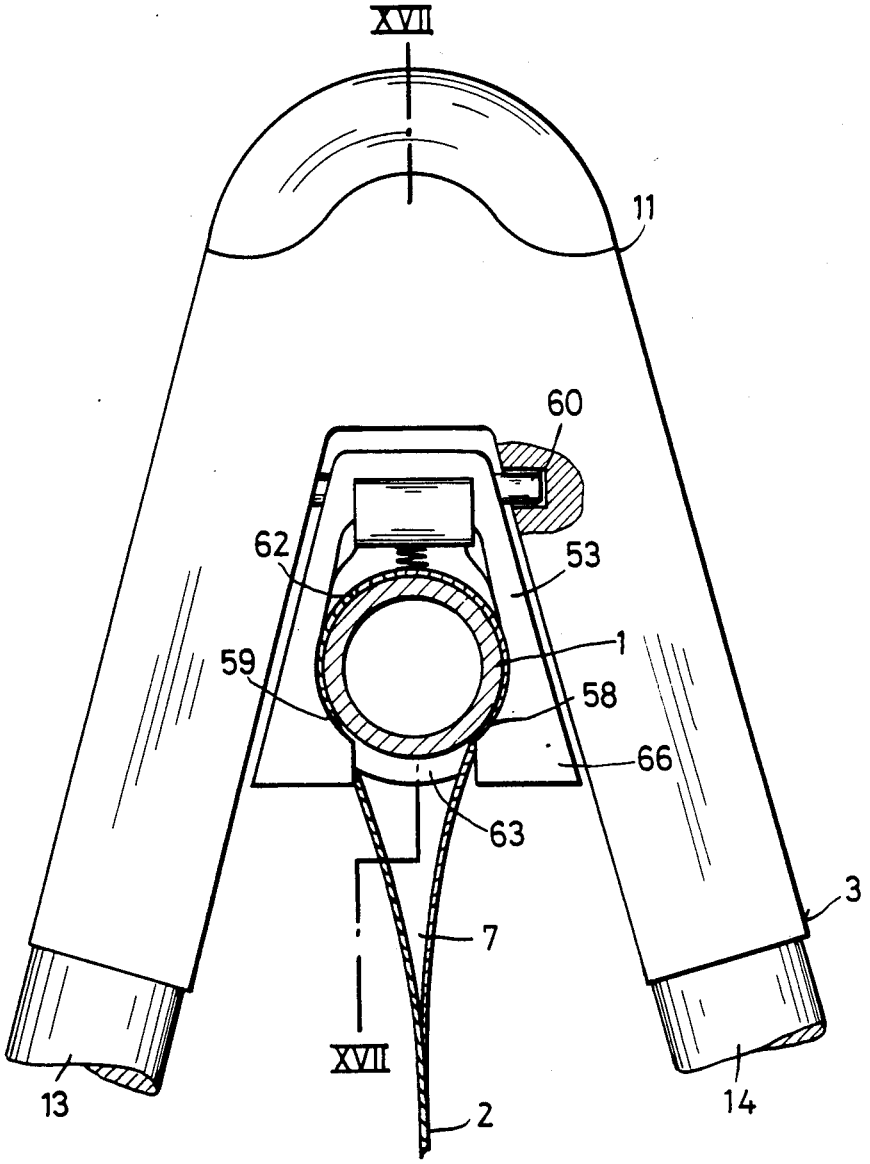
FIG. 16 is a sectional view corresponding to FIG. 14 of a modified embodiment.
Figure 17:
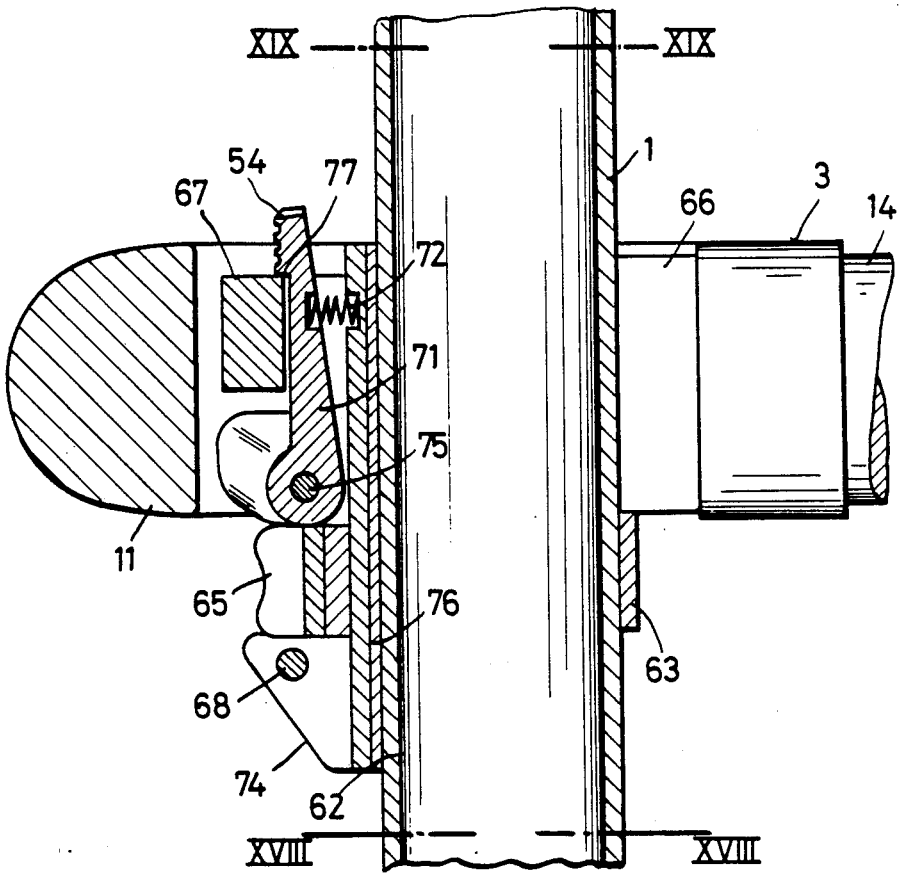
FIG. 17 is a sectional view of FIG. 16 along the line XVII—XVII.
Figure 18:
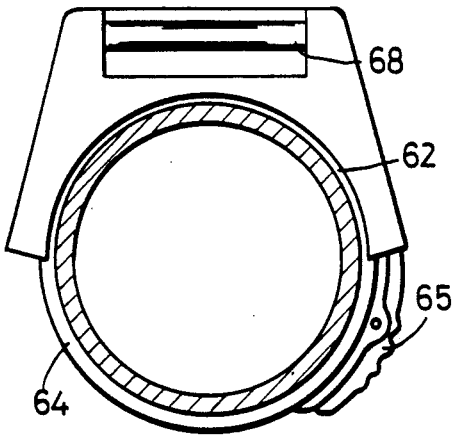
FIG. 18 is a sectional view along the line XVIII—XVIII of FIG. 17.
Figure 19:
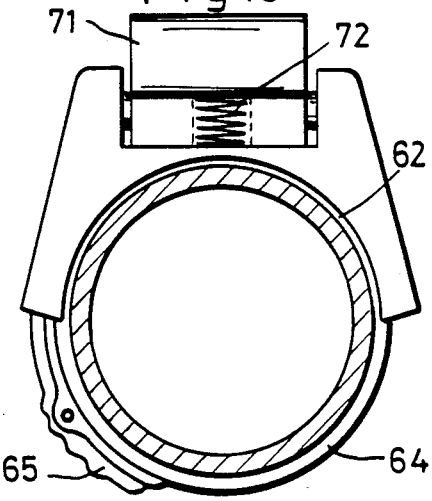
FIG. 19 is a sectional view along the line XIX—XIX of FIG. 17.

The embodiment according to FIGS. 16 and 17 differs from the embodiment according to FIGS. 14 and 15 in that in this case the pawl means 52 and the associated catch means 53 are constructed differently. For the same or similarly acting parts the same reference numerals are again employed so that reference can be made to the above description.

In the embodiment according to FIGS. 16 and 17 the bearing faces 58, 59 are provided on a substantially U-shaped bearing block 66 which on the bow side of the wishbone boom 3 comprises a detent surface 67 for the pawl means 52. On downward movement of the wishbone boom 3 the pawl 71 is again released until it comes into engagement with a projection 77 with the detent surface 67.

Figure 20:
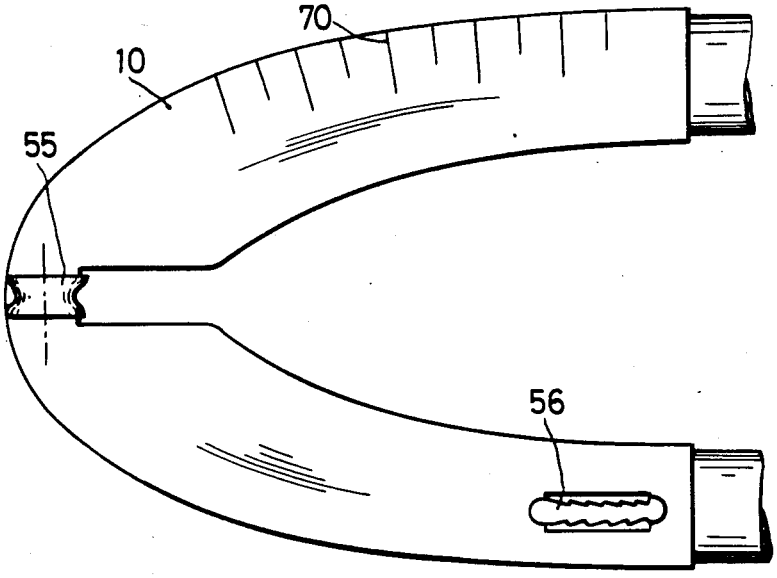
FIG. 20 is a schematic illustration of an ebodiment of the stern fitting 10 for the embodiment of the rig illustrated in FIG. 13.

As further indicated in FIG. 20 in the embodiments according to FIGS. 13 to 19 it is preferable to provide interchangeable stern fittings 10 for the wishbone boom 3. Such stern fittings possibly comprise a scale 70 by means of which the clew 8 is preset in the usual manner in a corresponding trim position, in the pressure-less condition of the sail 2, by fixing the clew 8 by means of leading the trim rope 57 round a deflection point 55 and securing it in a belaying cleat 56.

In the embodiments of FIGS. 13 to 20 the preferred procedure will therefore be either to use end fittings 10 adapted in length to the sails or to allow a trim within the limits defined for example by the scale 70, covering various sail sizes.

Examples of embodiment of the invention have been described above but it wll be obvious to the expert that changes and modifications can be made without leaving the fundamental idea of the invention which is seen in conducting the trimming of the sail 2 in a completely unconventional manner in the region of the fore leech. Such modifications may for example be in particular the form of the connection between the mast and wishbone boom and the adjustability. The essential underlying idea of the second fundamental embodiment of the invention is to as it were preprogram the correct trim of the sail by the position of the clew in the wishbone boom end fitting whereafter the wishbone boom bow fitting is brought into engagement after pushing down along the mast.

All features and advantages of the invention apparent from the description, claims and drawings, including constructional details and spatial arrangements, can be essential to the invention both on their own and in any desired combination.

I claim:

1. A rig for a windsurfing board comprising:

(a) a mast attached to a wind surfing board by a joint which is freely rotatable and pivotable in all directions;

(b) a sail which receives said mast in a mast pocket which forms the fore leech; and (c) a wishbone boom comprising two outwardly and oppositely curved boom arms joined at a bow fitting and a stern fitting, said bow fitting being slidably disposed about said mast and said mast pocket and having a coupling means comprising a pawl means (52) secured vertically adjustably to the mast and being releasable by hand using a catch means exerting a force opposite that of said coupling means for slidably engaging said mast and mast pocket, and said stern fitting comprising a securing means for holding the clew;

whereby the trim of said sail is set by raising and lowering said bow fitting and locking the bow fitting in position with said coupling means.

2. A rig according to claim 1 wherein said pawl means is spring-biased into the closure position

3. A rig according to claim 1 wherein said pawl means comprises cam faces.

4. A rig according to claim 1 wherein said catch means comprises bearing faces bearing on both sides of said mast

5. A rig according to claim 4 wherein said bearing faces are pivotably mounted about an axis with respect to the bow fitting.

6. A rig according to claim 5 wherein said bearing faces are provided on a substantially U-shaped bearing block which also bears a detent surface for said pawl means.

7. A rig according to claim 1 wherein the position of the clew with respect to the stern fitting is substantially fixed.

8. A rig according to claim 1 whrein the position of the clew with respect to the stern fitting is adjustable.

9. A rig according to claim 1 wherein said stern fitting is provided with a deflection point and a cleat.

10. A rig according to claim 1 wherein a scale is provided on the stern fitting for determining the position of the clew.

11. A rig according to claim 4, which also comprises a stirrup member (61) which engages the mast in form-locking manner into the pawl means.

12. A rig according to claim 1 wherein the pawl means has an hemispherical bearing face which partially engages around the mast and is held with a releasable fastening means on the mast.

13. A rig according to claim 2 wherein said fastening means is a plastic band encircling the mast and which is held by an eccentric clasp.

14. A rig according to claim 1 wherein a securing means for a start rope is provided on said pawl means.

15. A rig according to claim 1 wherein said sail is trimmed by displacement of said mast in said boom.

16. A rig according to claim 7, wherein a securing means (32) is formed by one or more shafts (35) extending through the clew (8).

17. A rig according to claim 7, wherein the stern fitting (10) is divided and connectable by a fastener (39).

18. A rig according to claim 17, wherein the fastener (32) is formed by a shaft (35) which is fixedly connected to one half (33) of the stern fitting (10) and a slide (39) which is disposed in the other half (34) and which is adapted to engage in a groove (38) at the free end of the shaft (35).

19. A rig according to claim 18, wherein the stern fitting (10) comprises a slot (41) for receiving the clew (8) and a shaft (35) which can be pushed therethrough.

20. A rig according to claim 1, characterized in that the stern fitting (10) is interchangeable.

21. A rig according to claim 1 wherein the mast (1) or on the mast pocket (7) and in the bow fitting (11) of the wishbone boom (3) scales (50, 49) are provided which are correlated with each other for an optimum trim.

* * * * *